US009588541B1

(12) United States Patent
Ho et al.

(10) Patent No.: US 9,588,541 B1
(45) Date of Patent: Mar. 7, 2017

(54) DUAL LOOP REGULATOR CIRCUIT

(71) Applicant: QUALCOMM Incorporated, San Diego, CA (US)

(72) Inventors: Ngai Yeung Ho, San Diego, CA (US); Hua Guan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 7 days.

(21) Appl. No.: 14/928,703

(22) Filed: Oct. 30, 2015

(51) Int. Cl.
*G05F 3/26* (2006.01)

(52) U.S. Cl.
CPC ..... *G05F 3/267* (2013.01)

(58) Field of Classification Search
CPC . G05F 3/26; G05F 3/262; G05F 3/265; G05F 3/267; G05F 3/30
USPC ..... 323/315–317; 327/538, 543
See application file for complete search history.

(56) References Cited

U.S. PATENT DOCUMENTS 6,147,550 A * 11/2000 Holloway ..... G05F 3/205 327/538
7,504,814 B2 * 3/2009 Lee ..... G05F 1/575 323/281
2003/0224624 A1 * 12/2003 Gay ..... G05F 3/242 438/800
2007/0139030 A1 * 6/2007 Lee ..... G05F 3/30 323/315
2009/0189591 A1 * 7/2009 Sperling ..... G05F 3/30 323/315
2014/0139198 A1 * 5/2014 Manlove ..... G05F 1/10 323/282
2014/0266103 A1 9/2014 Wang et al.
2014/0277812 A1 * 9/2014 Shih ..... G05F 1/563 700/298
2015/0103566 A1 4/2015 Keogh et al.
2015/0168969 A1 6/2015 Shor
2015/0192943 A1 * 7/2015 Roham ..... G05F 1/575 323/273
2015/0349622 A1 12/2015 Lo et al.

OTHER PUBLICATIONS

Lu Y., et al., "A 0.65ns-Response-Time 3.01ps FOM Fully-Integrated Low-Dropout Regulator with Full-Spectrum Power-Supply—Rejection for Wideband Communication Systems," IEEE International Solid-State Circuits Conference, Technical Papers, Feb. 2014, pp. 306-307. Retrieved from the Internet: URL:http://www.researchgate.net/publication/271550565.

* cited by examiner

*Primary Examiner* — Yemane Mehari
(74) *Attorney, Agent, or Firm* — Haynes and Boone, LLP

(57) ABSTRACT

The embodiments described herein relate to an improved regulator circuit technique having a dual-loop configuration with a current regulation loop to provide the transient response and a voltage regulation loop to provide accurate DC voltage regulation. The current regulation loop comprises a pass transistor, a current sensing transistor, a current summation circuit, and a series of current mirrors to provide a fast load transient response current. The voltage regulation loop includes an output voltage feedback network, an error amplifier, a compensation capacitor, and the current sensing transistor and is configured to provide accurate DC offset regulation to diminish output voltage errors introduced by the transient load currents.

30 Claims, 12 Drawing Sheets

DUAL LOOP REGULATOR CIRCUIT

FIELD OF THE INVENTION

At least certain embodiments disclosed herein relate generally to electronic circuits, and more particularly to an improved regulator circuit configuration.

BACKGROUND

Electronic systems typically require one or more regulated voltages to power various subsystems. A regulator is a circuit that may receive an input voltage and produce a regulated output voltage that may be at a different voltage level than the input voltage. One common type of regulator circuit is a low dropout regulator ("LDO"). An LDO regulator is a DC linear voltage regulator which can regulate the output voltage even when the input (or supply) voltage is very close to the output voltage.

One common problem associated with regulators, such as LDO regulators for example, is that the controller of a LDO may constitute a large portion of the entire LDO integrated circuit device area. This can be significant when the LDO is rated for small power handling. LDO controllers include circuitry to regulate and stabilize output voltage over a wide range of load currents including transient currents, as well as circuitry for overcurrent protection. A large compensation capacitor is also used in conventional designs for dominant pole and load tracking zero. Overcurrent protection is accomplished by a separate loop from the main loop. A separate soft start circuit is also needed to avoid inrushing current during LDO start up.

FIG. 1 depicts an example circuit diagram of a conventional LDO controller circuit configuration with separate current and voltage regulation loops according to the prior art. Circuit 10 includes an error amplifier 101, a buffer circuit 102, a compensator circuit 103, a feedback network 105, an overcurrent protection ("OCP") control circuit 106, a pass transistor $M_{PASS}$ and a sensing transistor $M_{SEN}$. The output $V_{OUT}$ of the LDO 10 is coupled with a capacitive load $C_{Load}$ and a variable resistive load $R_{Load}$.

As shown, circuit 10 includes two separate loops for regulating the voltage and current in the LDO controller. The voltage regulation path $V_{Loop}$ includes a pass transistor $M_{PASS}$ coupled between the input voltage $V_{IN}$ and the output voltage $V_{OUT}$. It also includes the error amplifier 101, buffer circuit 102, compensator circuit 103, and a feedback network 105 coupled with the pass transistor $M_{PASS}$. The feedback network 105 provides a first input to the error amplifier 101, which is compared to a reference voltage $V_{ref}$ for driving the output $V_{amp_out}$ of the error amplifier. The overcurrent protection path $OCP_{Loop}$ includes a current sensing transistor $M_{SEN}$, the OCP control circuit 106, the error amplifier 101, the buffer circuit 102, and the compensator circuit 103. The output of the OCP control circuit 106 is provided to a control input of the error amplifier 101 to control the output signal $V_{amp_out}$ of the error amplifier 101.

The disadvantages of the LDO controller circuit 10 include that it requires a substantial amount of integrated circuit area for all the circuit elements. The error amplifier 101, buffer circuit 102, and compensator circuit 103 each must be large in order to stabilize circuit 10 across process, voltage, and temperature variations, different output loading, and external capacitance and printed circuit board ("PCB") parasitic variations within a single complicated loop. In addition, a separate OCP loop and a soft start circuit (not shown) are needed. These require extra load current sensing, OCP loop compensation, and $V_{ref}$ ramp circuitry. Further, due to the single loop nature of the LDO controller circuit 10, very high switching frequency is required if a duty cycle-based feedback network is used, which will increase dynamic switching losses.

Another example of a conventional LDO controller is shown in FIG. 2, which depicts an example circuit diagram of a Flipped Voltage Follower-based LDO controller circuit structure according to the prior art. In this configuration, there are two loops for stability and transient response. The main drawbacks of circuit 20 include that stability can only be achieved with very small capacitive load $C_L$, and that the LDO cannot operate when large headroom is given—when $V_{IN}$ is higher than $V_{OUT}$, $V_G$ is limited by $V_{OUT}+V_{GS}$ (for transistor M9).

SUMMARY

The embodiments described herein relate to an improved regulator circuit technique, which may be used in a low dropout regulator ("LDO") controller circuit, for example. In one embodiment, the present disclosure includes a regulator circuit comprising a current regulation loop and a voltage regulation loop. The current regulation loop comprises a pass transistor having a first terminal coupled with an input of the regulator circuit and a second terminal coupled with an output of the regulator circuit, a current sensing transistor configured to sense a load current at a first terminal coupled with the output of the regulator circuit and to output a first loop current complementary to the load current from a second terminal of the current sensing transistor, a first current mirror circuit comprising a first transistor pair configured to receive the first loop current and to mirror the first loop current from input to output of the first current mirror circuit, a current summation circuit configured to subtract the first loop current at the output of the first current mirror circuit from a constant current provided by a current source to obtain a difference current, and at least a second current mirror circuit comprising a second transistor pair coupled with the current summation circuit and configured to convey the difference current multiplied by a factor to the pass transistor to provide a response current at the output of the regulator circuit.

In one embodiment, the voltage regulation loop comprises an input coupled to an output voltage of the regulator circuit and an output coupled to a control terminal of the sense transistor.

In one embodiment, the voltage regulation loop further comprises a compensation capacitor coupled to a control terminal of the sense transistor. In one embodiment, the voltage regulation loop further comprises a capacitor multiplier circuit coupled with the compensation capacitor.

In one embodiment, the voltage regulation loop comprises an operational amplifier configured to detect an error in an output voltage of the regulator circuit by comparing an output feedback voltage at a first input terminal of the operational amplifier with a reference voltage at a second input terminal of the operational amplifier and drive an output node of the operational amplifier to a value to correct the error in the output voltage, wherein the output node of the operational amplifier is coupled with a control terminal of the current sensing transistor.

In one embodiment, the output node of the operational amplifier is configured to drive the control terminal of the current sensing transistor as voltage across the current sensing transistor changes with the load current.

In one embodiment, the current regulation loop further comprises a third current mirror circuit comprising a third transistor pair including the pass transistor, the third current mirror circuit configured to receive the difference current multiplied by a first multiplication factor from the second current mirror circuit to obtain a second loop current and mirror the second loop current from input to output of the third current mirror circuit to convey the difference current multiplied by a second multiplication factor to the pass transistor at the output of the regulator circuit.

In one embodiment, the first multiplication factor is determined based on relative device sizes of the second transistor pair of the second current mirror circuit, and the second multiplication factor is determined based on relative device sizes of the third transistor pair of the third current mirror circuit.

In one embodiment, during times of increased load current at the output of the regulator circuit, the first loop current decreases and current conveyed to the output of the regulator circuit increases to compensate for the increased load current.

In one embodiment, during times of decreased load current on the output of the regulator circuit, the first loop current increases and current conveyed to the output of the regulator circuit decreases to compensate for the decreased load current.

In one embodiment, during times of increased load current at the output of the regulator circuit, the first loop current increases and current conveyed to the output of the regulator circuit increases to compensate for the increased load current.

In one embodiment, during times of decreased load current on the output of the regulator circuit, the first loop current decreases and current conveyed to the output of the regulator circuit decreases to compensate for the decreased load current.

In one embodiment, maximum current conveyed to the output of the regulator circuit is limited by the constant current provided by the current source.

In one embodiment, the regulator circuit further comprises a sample and hold circuit configured to provide a sampled output voltage at the output of the regulator circuit.

In one embodiment, the regulator circuit is a low drop out (LDO) regulator.

In another embodiment, the present disclosure includes regulator circuit comprising a pass transistor having a first terminal to receive an input voltage, a second terminal to provide a regulated output voltage to an output of the regulator circuit, and a control terminal, a current sense transistor having a first terminal coupled with the second terminal of the pass transistor at the output of the regulator circuit, a second terminal, and a control terminal, a current regulation loop coupled between the second terminal of the current sense transistor and the control terminal of the pass transistor, the current regulation loop comprising a plurality of current mirrors and one or more current summation circuits, and a voltage regulation loop coupled between the output of the regulator circuit and the control terminal of the current sense transistor.

In one embodiment, the pass transistor is a PMOS transistor and the current sense transistor is a PMOS transistor, and wherein a source of the current sense transistor is coupled to a drain of the pass transistor.

In one embodiment, the pass transistor is a NMOS transistor and the current sense transistor is a NMOS transistor, and wherein a source of the current sense transistor is coupled to a source of the pass transistor.

In one embodiment, when a current through the current sense transistor increases, the current regulation loop decreases a current through the pass transistor, and wherein when the current through the current sense transistor decreases, the current regulation loop increases the current through the pass transistor.

In one embodiment, when a current through the current sense transistor increases, the current regulation loop increases a current through the pass transistor, and wherein when the current through the current sense transistor decreases, the current regulation loop decreases the current through the pass transistor.

In another embodiment, the present disclosure includes a method of generating a regulated voltage comprising receiving an input voltage on a first terminal of a pass transistor, and in accordance therewith, providing a regulated output voltage from a second terminal of the pass transistor to an output of the regulator circuit, sensing a current in a current sense transistor that is complementary to a load current, the current sense transistor having a first terminal coupled with the second terminal of the pass transistor at the output of the regulator circuit, coupling the current in the current sense transistor through a plurality of current mirrors and one or more current summation circuits to form a current regulation loop, wherein one of the current mirrors includes the pass transistor, and coupling the output voltage from the output of the regulator circuit to a control terminal of the current sense transistor to form a voltage regulation loop.

In one embodiment, the method further comprises detecting an error in the output voltage of the regulator circuit resulting from the load current by comparing an output feedback voltage at a first input terminal of an operational amplifier with a reference voltage at a second input terminal of the operational amplifier and driving an output node of the operational amplifier to a value to correct the output voltage, wherein the output node of the operational amplifier is coupled with the control terminal of the current sensing transistor.

In one embodiment, the output node of the operational amplifier is configured to change a voltage on a capacitor coupled to the control terminal of the current sensing transistor as voltage across the current sensing transistor changes with the load current.

In one embodiment, when the current through the current sense transistor increases, the current regulation loop decreases a current through the pass transistor, and wherein when the current through the current sense transistor decreases, the current regulation loop increases the current through the pass transistor.

In one embodiment, when the current through the current sense transistor increases, the current regulation loop increases a current through the pass transistor, and wherein when the current through the current sense transistor decreases, the current regulation loop decreases the current through the pass transistor.

In one embodiment, maximum current in the pass transistor is limited by a constant current provided by a current source in at least one current summation circuit.

In one embodiment, the method further comprises providing a sampled output voltage at the output of the regulator circuit using a sample and hold circuit.

In another embodiment, the present disclosure includes a regulator circuit comprising pass transistor means for receiving an input voltage and providing an output voltage to an output of the regulator circuit, means for generating a complementary current to a load current at the output of the regulator circuit, means for mirroring the complementary current and performing one or more current summations to form a current regulation loop with the pass transistor means, and means for coupling the output voltage from the output of the regulator circuit to the means for generating a complementary current to form a voltage regulation loop.

In one embodiment, the circuit further comprises a capacitor means for compensating for voltage fluctuations at output of the regulator circuit and a capacitor multiplier means for reducing the device size of the capacitor means.

In one embodiment, the circuit further comprises means for providing a sampled output voltage at output of the regulator circuit.

The following detailed description and accompanying drawings provide a better understanding of the nature and advantages of the present invention.

BRIEF DESCRIPTION OF THE DRAWINGS

For a better understanding of at least certain embodiments, reference will be made to the following detailed description, which is to be read in conjunction with the accompanying drawings.

DETAILED DESCRIPTION

Figure 1:
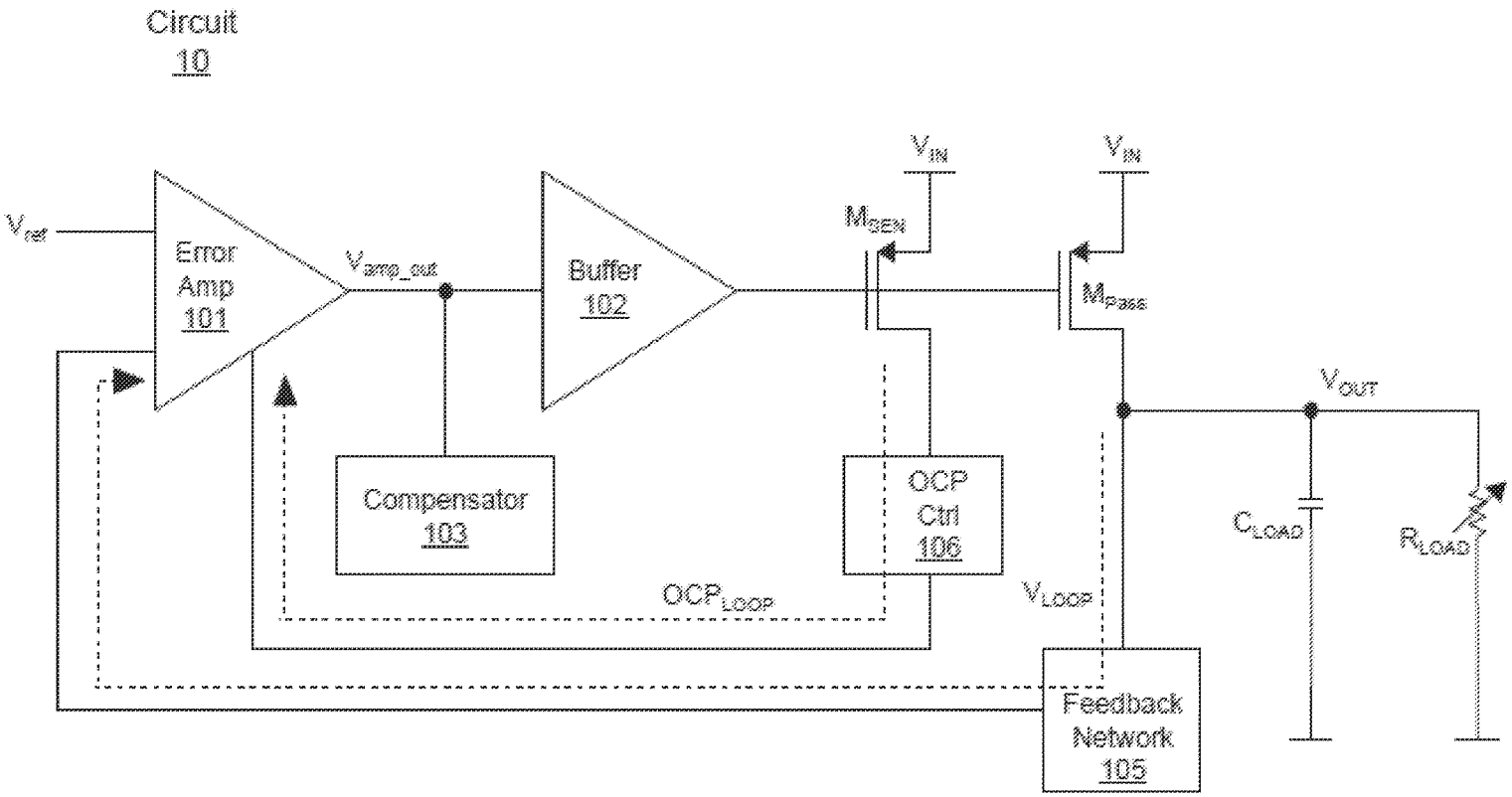
FIG. 1 (Prior Art)
FIG. 1 depicts an example circuit diagram of a conventional LDO controller circuit configuration with separate current and voltage regulation loops according to the prior art.
Figure 2:
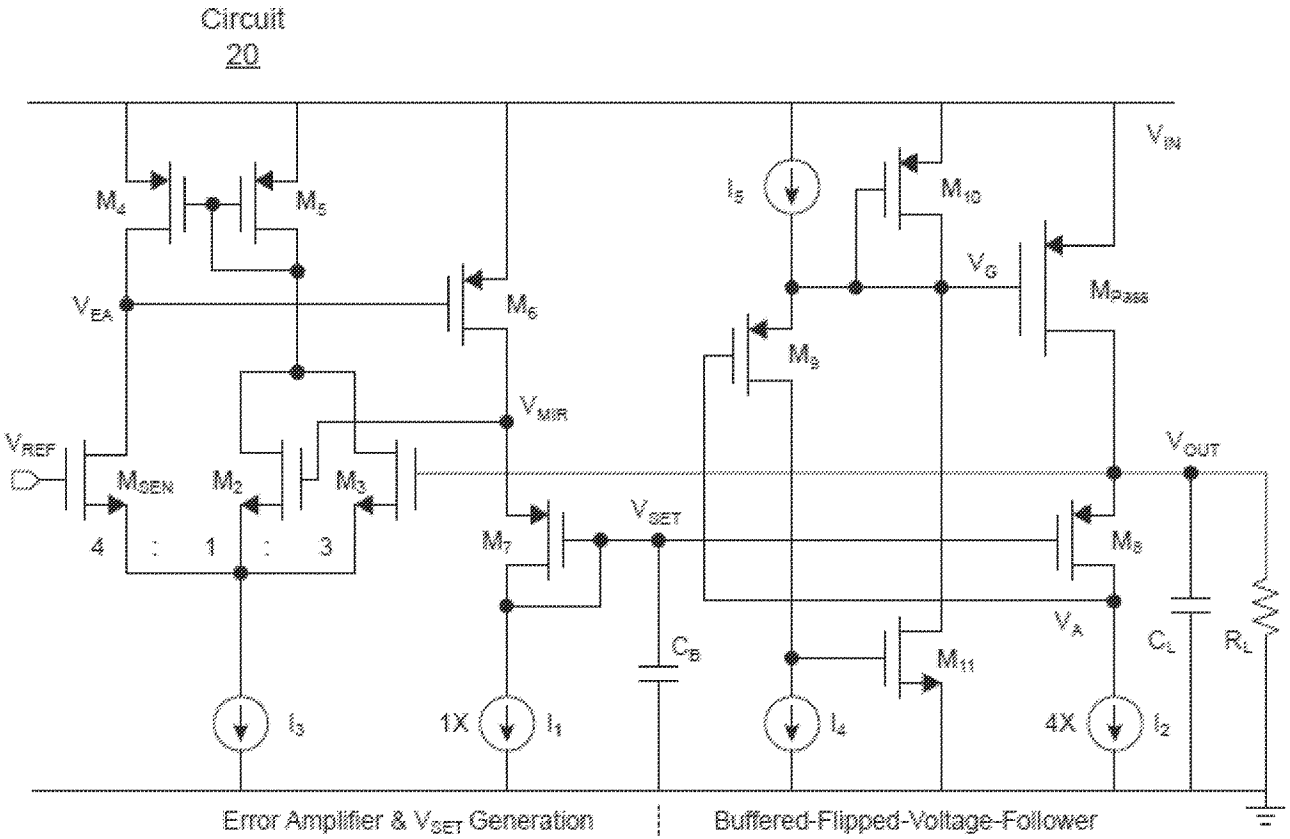
FIG. 2 (Prior Art)
FIG. 2 depicts an example circuit diagram of a Flipped Voltage Follower-based LDO controller circuit structure according to the prior art.

Throughout the description, for the purposes of explanation, numerous specific details are set forth in order to provide a thorough understanding of the present disclosure. It will be apparent to one skilled in the art, however, that the techniques described herein may be practiced without some of these specific details. In other instances, well-known structures and devices may be shown in block diagram form to avoid obscuring the underlying principles of the present disclosure.

The embodiments of the regulator circuit configuration described herein include a dual-loop configuration comprising a current regulation loop configured to regulate the output current to provide a fast response to load current transient conditions at the output of the regulator, and a voltage regulation loop configured to regulate the output voltage to provide accurate DC voltage. In one embodiment, the current regulation loop is referred to as the fast current loop because it is configured to provide fast load current transient responses, and the voltage regulation loop is referred to as the slow voltage loop because it is configured to stabilize the output voltage to provide accurate DC voltage regulation. Example embodiments are disclosed below in the context of an LDO regulator circuit, but such example should not be construed as limited to LDO applications.

In some embodiments, the current regulation loop includes a current sensing transistor and a series of current mirror circuits configured to mirror transient load currents occurring at the output $V_{OUT}$ of an LDO through the current regulation loop and back out to the output $V_{OUT}$ to provide a transient response current to the output of the LDO controller circuit. When a transient load current occurs at the output of the LDO, the transient current conducts in the current sensing transistor and is provided to a first current mirror circuit.

This current can then be mirrored from input to output of the first current mirror circuit, and the resulting current can then be subtracted from a constant current provided by a current source at a current summation circuit to yield a difference current. The difference current can then be conveyed to feed a transient response current to the output of the LDO controller circuit to compensate for the current fluctuation resulting from the transient load current. In one embodiment, the difference current is conveyed to the output of the LDO controller circuit through a series of one or more additional current mirror circuits.

The overshoot/undershoot performance of the LDO controller circuit described herein is therefore dominated by the current regulation loop. During times of increased transient load current at the output of the LDO controller circuit, the first loop current decreases and current conveyed to the output of the LDO controller circuit increases to compensate for the increased transient load current, and during times of decreased transient load current on the output of the LDO controller circuit, the first loop current increases and current conveyed to the output of the LDO controller circuit decreases to compensate for the decreased transient load current.

In addition, during an over-current condition, the current conducting in the current sensing transistor drops to zero. All current from the current source in the current summation circuit is therefore conveyed to the output $V_{OUT}$ of the LDO. The maximum current is limited by the constant current provided by the current source.

The voltage regulation loop includes an error amplifier with an output node coupled with the gate terminal of the current sensing transistor. When positive transient load current is drawn from the output of the LDO, a DC offset (i.e., error) appears in the voltage $V_{OUT}$ at the output of the LDO and the gate-to-source voltage $V_{gs}$ of the current sensing transistor is reduced. The error amplifier is configured to detect these output voltage errors resulting from the transients in the load current.

The output voltage errors are detected by the error amplifier by comparing an output feedback voltage $V_{fb}$ received at the first input terminal of the error amplifier with a reference voltage $V_{ref}$ received at the second input terminal of the amplifier. When these two voltages differ, the error amplifier is configured to detect the difference and to drive its output node to a value to correct the output voltage error. The output node of the error amplifier drives the gate terminal of the current sensing transistor to a new value to provide accurate DC voltage regulation. After the output node of the error amplifier is stabilized, the DC error of $V_{OUT}$ introduced by the current subtraction loop will be diminished.

In some example embodiments disclosed herein, the voltage regulation loop further comprises a single compensation capacitor configured to compensate for voltage fluctuations at the output node of the operational amplifier. The voltage regulation loop also includes a capacitor multiplier circuit coupled with the compensation capacitor. The capacitor multiplier circuit is configured to reduce the device size of the compensation capacitor by increasing the alternating current ("AC") across the compensation capacitor.

In at least certain embodiments, the voltage regulation loop can include a sample and hold circuit at the output of the LDO controller circuit to further reduce feedback network quiescent current. The LDO controller circuit is therefore configured such that the transient response of the voltage regulation loop can be slower in correcting output voltage errors while maintaining accurate DC voltage regulation. The feedback network providing the feedback voltage $V_{fb}$ to the error amplifier can be driven by a lower frequency duty cycle. The lower bandwidth voltage regulation loop can tolerate a slower switching feedback network duty cycle, which decreases the integrated circuit device area required to regulate the output voltage as compared to conventional solutions. In addition, switching losses can be significantly reduced at lower switching frequencies.

I. Exemplary Circuit

Provided below is a description of an example circuit upon which the embodiments described herein may be implemented. Although certain elements may be depicted as separate components, in some instances one or more of the components may be combined into a single component or device. Likewise, although certain functionality may be described as being performed by a single element or component within the circuit, the functionality may in some instances be performed by multiple elements or components working together in a functionally coordinated manner.

Figure 3A:
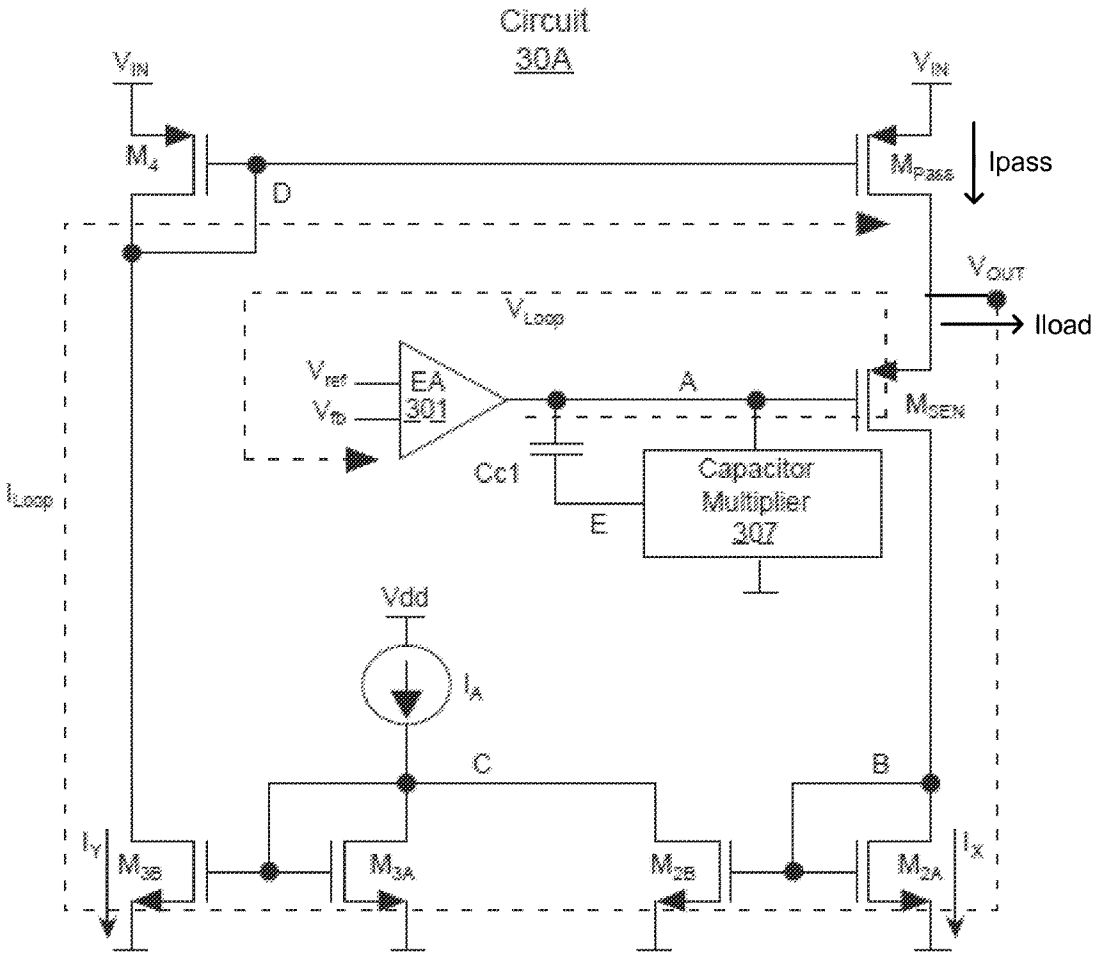
FIG. 3A depicts a circuit diagram of an example embodiment of a regulator circuit with a dual-loop current and voltage regulation configuration designed according to the techniques described herein.

FIG. 3A depicts a circuit diagram of an example embodiment of a LDO controller circuit with a dual-loop current and voltage regulation configuration designed according to the techniques described herein. In the illustrated embodiment, the LDO controller circuit 30A includes a current regulation loop $I_{LOOP}$ and a voltage regulation loop $V_{LOOP}$. The current regulation loop includes a current sensing transistor $M_{SEN}$ and a series of current mirror circuits comprising transistor pairs $M_{2B}/M_{2A}$, $M_{3B}/M_{3A}$, and $M_{PASS}/M_4$. In at least certain embodiments, the fast $I_{LOOP}$ includes a single dominant pole low gain current loop. All nodes B, C, and D are low impedance except the output node $V_{OUT}$ since it drives a large load capacitance.

Figure 3B:
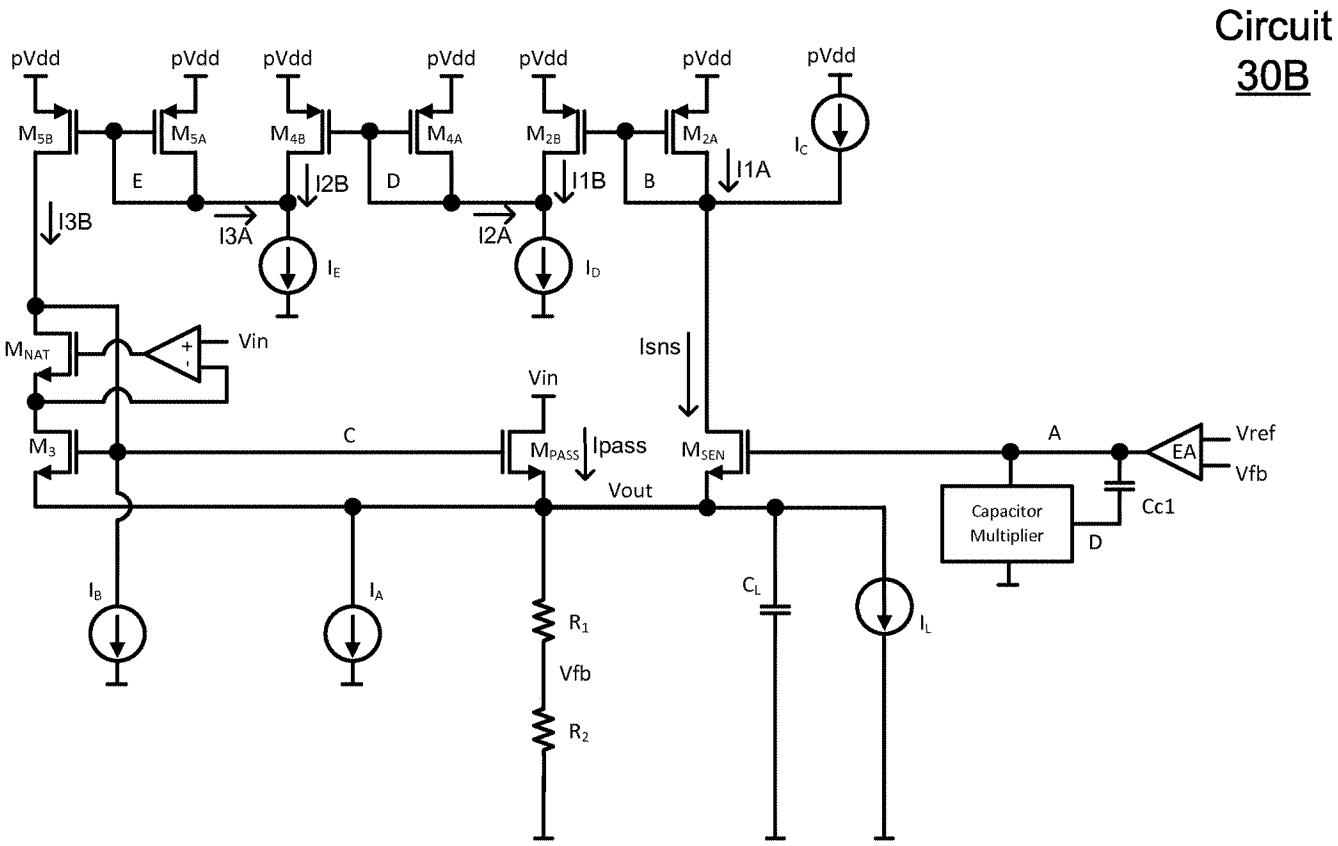
FIG. 3B depicts a circuit diagram of an alternate example embodiment of a regulator circuit with a dual-loop current and voltage regulation configuration designed according to the techniques described herein.

The $M_{PASS}$ transistor is configured to provide a response current to the output of the LDO. The pass transistor $M_{PASS}$ has a first terminal coupled with an input $V_{IN}$ of the LDO and a second terminal coupled with the output $V_{OUT}$ of the LDO. In one embodiment, the first terminal of the $M_{PASS}$ transistor is its source terminal and the second terminal is its drain terminal. As described in more detail below, Mpass is one example mechanism for receiving an input voltage and providing an output voltage to an output of the regulator circuit. Another example is shown in FIG. 3B.

The current sensing transistor $M_{SEN}$ is configured to sense a transient load current at a first terminal coupled with the second (e.g., drain) terminal of the $M_{PASS}$ transistor and with the output of the LDO. Msen is one example mechanism for generating a complementary current to a load current at the output of the regulator circuit. Another NMOS example is shown in FIG. 3B. $M_{SEN}$ is configured to output a first loop current $I_X$ complementary to the transient load current. For example, current through the pass transistor, Mpass, may be equal to the sum of the load current, Iload, and the current through the sense transistor, $I_{SNS}$ (e.g., Ipass=Isns+Iload). Accordingly, the sense transistor $M_{SEN}$ senses the load current because Isen is equal to the current through the pass transistor Mpass minus the load current (e.g., Isns=Ipass−Iload). $M_{SEN}$ outputs the first loop current $I_X$ from a second (e.g., drain) terminal to an input transistor $M_{2A}$ of a first current mirror circuit.

The first current mirror circuit includes a first transistor pair $M_{2B}/M_{2A}$ configured to receive the first loop current $I_X$ and to mirror current $I_X$ from the input transistor $M_{2A}$ to the output transistor $M_{2B}$ of the first current mirror circuit. As appreciated by persons of skill in the art, the ratio of transistor device sizes in current mirror circuits determines the relative magnitude of mirrored current that will be replicated from the input transistor to the output transistor. That is, the output current will be given by the input current multiplied by a multiplication factor determined by the device size of the output transistor divided by the device size of the input transistor.

The current regulation loop $I_{LOOP}$ further includes a current summation circuit comprising a current source $I_A$ coupled between a voltage source $V_{DD}$ and the current summation node C. The current source $I_A$ is configured to provide constant current to node C of the current summation circuit. The current from the current source $I_A$ is split at node C and conducts in transistors $M_{2B}$ and $M_{3A}$. The current conducting in transistor $M_{3A}$ is equal to the current conducting in transistor $M_{2B}$ subtracted from the constant current from current source $I_A$.

The current summation circuit is coupled with the output transistor $M_{2B}$ and is configured to subtract the first loop current conducting in $M_{2B}$ from a constant current provided by the current source $I_A$ to obtain a difference current transistor $M_{3A}$. In the illustrated embodiment, the current regulation loop $I_{LOOP}$ further includes a second current mirror circuit comprising a second transistor pair $M_{3B}/M_{3A}$ coupled with the current summation circuit and configured to mirror the difference current from the input transistor $M_{3A}$ to the output transistor $M_{3B}$. The magnitude of the resulting current $I_Y$ conducting in transistor $M_{3B}$ will be given by a multiplication factor based on the ratio of transistor device sizes $M_{3B}/M_{3A}$.

In the illustrated embodiment, the resulting current conducting in the output transistor $M_{3B}$ of the second current mirror circuit is mirrored again by a third current mirror circuit comprising a third transistor pair $M_4/M_{PASS}$ and provided to the output of the LDO controller circuit 30A via the second (e.g., drain) terminal of the pass transistor $M_{PASS}$.

Accordingly, the above described current mirrors and current summing circuits are one mechanism for mirroring complementary current and performing one or more current summations to form a current regulation loop with the pass transistor. Another example mechanism for performing this function includes current mirrors and summing circuits shown below in FIG. 3B. It should be noted that the novel circuit techniques described herein are not limited to any particular multiplication factor or combination thereof. Other multiplication factors and combinations of multiplication factors can be utilized to achieve a desired transient response current conducting at the output of the LDO controller circuit based on the various tradeoffs of a particular circuit design.

The pass transistor $M_{PASS}$ supplies the response current at the output of the LDO controller circuit 30A. The response current at the output of the LDO controller circuit is given by the difference current conducting in the output transistor $M_{3A}$ of the second current mirror circuit multiplied by a factor. In this example, that factor includes the first multiplication factor of the first current mirror circuit $M_{2B}/M_{2A}$ multiplied by the second multiplication factor of the second current mirror circuit $M_{3B}/M_{3A}$ multiplied by the third multiplication factor of the third current mirror circuit $M_{PASS}/M_4$.

The embodiments described herein are configured to convey the difference current multiplied by one or more multiplication factors to the pass transistor $M_{PASS}$ at the output $V_{OUT}$ to compensate for transient load currents at the output of the LDO controller circuit 30A. The current gain achieved by the multiplication factors can then be supplied to the output $V_{OUT}$ of the LDO to correct the change in current flow due to the transient load current. Accordingly, during times of increased transient load current at the output of the LDO, the first loop current decreases and the current conveyed to the output of the LDO controller circuit increases to compensate for the increased transient load current. And during times of decreased transient load current on the output of the LDO, the first loop current increases and current conveyed to the output of the LDO decreases to compensate for the decreased transient load current.

The maximum current in the current regulation loop $I_{LOOP}$ is limited by the constant current provided by the current source $I_A$. There is no need therefore for the extra OCP control and soft start circuits utilized in conventional LDO controllers. This saves substantial integrated circuit device area and circuit complexity. The maximum LDO controller current is given by the equation: $I_{LDO_MAX}=I_A*M_{3B}/M_{3A}*M_{PASS}/M_4$. In an over-current condition, $I_X$ drops to zero and all current in $I_A$ mirrors to $M_{PASS}$ at the output of the LDO controller circuit 30A. The output current is thus limited by the maximum value of $I_A$. In this manner, $I_A$ acts as the overcurrent protection mechanism of the circuit techniques described herein.

In the illustrated embodiment of FIG. 3A, the voltage regulation loop $V_{LOOP}$ of the LDO controller circuit 30A includes the same current sensing transistor $M_{SEN}$, as well as an error amplifier 301, a compensation capacitor Cc1 and a capacitor (e.g., a multiplier circuit) 307. These circuits are one example mechanism for coupling the output voltage from the output of the regulator circuit to the circuits for generating a complementary current to form a voltage regulation loop. Another example is shown in FIG. 3B. As will be appreciated by persons of skill in the art, an operational amplifier can be used to implement the error amplifier 301. In at least certain embodiments, the slow $V_{LOOP}$ includes a single dominant pole high gain voltage loop.

The error amplifier 301 is configured to detect an error (DC offset) in the output voltage of the LDO controller circuit resulting from the load currents. The error amplifier 301 is configured to receive an output feedback voltage $V_{fb}$ at its first input and a reference voltage $V_{ref}$ at its second input. Output voltage errors can be detected by the error amplifier 301 by comparing the output feedback voltage $V_{fb}$ at the first input terminal of the error amplifier with a reference voltage $V_{ref}$ at the second input terminal.

As will be appreciated by persons of skill in the art, the feedback voltage $V_{fb}$ can be taken from a feedback node in a resistor divider network coupled with the output voltage $V_{OUT}$ of the LDO. Such a resistor divider network is shown below with reference to FIG. 3B. The error amplifier 301 is configured to drive its output node A to correct the output voltage error in response to detecting the error. The error amplifier is configured to drive output node A as the voltages of $V_{fb}$ and $V_{ref}$ begin to differ at the input of the error amplifier 301.

The error amplifier 301 output node A is coupled with the gate terminal of the current sensing transistor $M_{SEN}$ to drive node A to a value to correct the error in the output voltage $V_{OUT}$. The output node A of the error amplifier drives the gate terminal of the current sensing transistor as the voltage across the current sensing transistor $M_{SEN}$ changes with the load current. For example, when more current (e.g., due to transient load current) conducts to the LDO output, the output voltage Vout may decrease. In response, the voltage regulation loop $V_{LOOP}$ drives the gate terminal of $M_{SEN}$ to a higher value to reduce Vgs, reduce Ix, and increase the output current, which in turn corrects the output voltage error introduced by the transient load current.

The LDO controller circuit 30A further includes a single compensation capacitor Cc1 configured to compensate for voltage fluctuations at the output node $V_{OUT}$ of the operational amplifier. In the illustrated embodiment of FIG. 3A, the compensation capacitor Cc1 is coupled with the output node A of the error amplifier 301. Cc1 can be utilized to stabilize the loop, and control overshoot and ringing in the step response of error amplifier 301.

The LDO regulator circuit further comprises a capacitor multiplier circuit 307 configured to reduce the device size of the compensation capacitor Cc1 as described below with reference to the embodiments described in circuit 70 of FIG. 7.

This completes the description of LDO controller circuit 30A according to one example embodiment. In one embodiment, the transistors described herein include Field Effect Transistor ("FET") technology. It should also be noted that, although certain embodiments may be described herein as utilizing FET technology, the circuit techniques described herein are not limited to any particular type of transistors. It will be appreciated by persons of skill in the art that other types of transistors or equivalent devices may be used to implement the circuit techniques described herein. For example, embodiments may be implemented with MOSFET, JFET, BJT, IGBT, GaAs, etc.

In addition, it should further be noted that although the techniques described herein are based on a PFET pass transistor configuration, persons of skill in the art will appreciate that many of the disclosed embodiments can also be based on a NFET pass transistor configuration.

FIG. 3B depicts a circuit diagram of an alternate example embodiment of a LDO circuit with an NMOS pass transistor implementation. In this example, an NMOS pass transistor Mpass receives an input voltage Vin on a first terminal (here, a drain) and produces an output voltage Vout on a second terminal (here, a source) at an output of the LDO circuit. In this example, a sense transistor Msns is also an NMOS transistor having a first terminal (e.g., a source) coupled to the second terminal of Mpass at the output of the LDO circuit. A second terminal of Msns (e.g., a drain) is coupled through a plurality of current mirrors and current summing circuits to the control terminal of Mpass to form a current control (i.e., regulation) loop. A control terminal of Msns is coupled to the output of the LDO regulator circuit in a voltage control (i.e., regulation) loop. In this embodiment, the resistor-divider network at the output of the LDO is shown comprising $R_1$ and $R_2$ is shown to feed back the voltage on the LDO output, Vout, to an error amplifier, loop voltage capacitor, and capacitor multiplier in the voltage control loop.

In the example regulator circuit shown in FIG. 30B, the current regulation loop comprises a first current mirror including transistors $M_{2A}$ and $M_{2B}$, a second current mirror comprising transistors $M_{4A}$ and $M_{4B}$, a third current mirror comprising transistors $M_{5A}$ and $M_{5B}$, and a current mirror comprising $M_3$ and pass transistor Mpass. The current regulation loop further includes two current summing circuits comprising a first constant current source producing a constant current $I_D$ coupled to a node between an output of the first current mirror $M_{2A}/M_{2B}$ and an input of the second current mirror $M_{4A}/M_{4B}$. The first current summing circuit sums the currents at the node between the constant current source $I_D$, the output of the first current mirror (i.e., the drain of $M_{2B}$) and the input of the second current mirror (i.e., the drain of $M_{4A}$). The current summation is given as follows: $I_{2A}=I_D-I_{1B}$, where $I_{1B}$ is the current in the first current mirror, $I_{2A}$ is the current in the second current mirror, and $I_D$ is the current from a first constant current source. The second current summing circuit sums the currents at the node between the constant current source $I_E$, the output of the second current mirror (i.e., the drain of $M_{4B}$) and the input of the third current mirror (i.e., the drain of $M_{5A}$). The current summation is given as follows: $I_{3A}=I_E-I_{2B}$, where $I_{2B}$ is the current in the second current mirror, $I_{3A}$ is the current in the third current mirror, and $I_E$ is the current from the constant current source. Current at the output of the third current mirror, $I_{3B}$, is coupled into $M_3$ and Mpass to generate an output current, Ipass, in Mpass. It is to be understood that any of the above current mirror circuits may comprise different sized transistors to produce current ratios between the input and output of each mirror to multiply an input current by different factors to produce an output current.

The configuration of Mpass and Msns in this example produces a first loop current complementary to the load current. For example, the relationship between the current in Mpass (Ipass), the current in Msns (Isns), and the load current (Iload) is as follows: Iload=Ipass+Isns. In this configuration, when the load current changes, Isns changes in the same direction, and the change in Isns is mirrored to produce a corresponding change in Ipass in pass transistor Mpass. For example, if Iload increases, Isns increases, $I_{1A/B}$ increase, $I_{2A/B}$ decrease (due to the current summation), and $I_{3A/B}$ increase (due to a second current summation), which causes Ipass increases. Similarly, if Iload decreases, Isns decreases, $I_{1A/B}$ decrease, $I_{2A/B}$ increase, and $I_{3A/B}$ decrease, which causes Ipass decreases. As Ipass responds to the current control loop, Isns returns to a steady state value. Similar to the example shown in FIG. 3A, the constant current sources $I_E$ may set a maximum current in Mpass. Note that in this example, small bias currents from current source Ic and current source $I_A$ are provided to set a minimum current in Msns and maintain the Vgs of Msns to a non-zero voltage. Further, a bias current source $I_B$ may be included to allow the gates of $M_3$ and Mpass to discharge.

Another optional feature of the present example is that a native transistor Mnat may be included and controlled by an amplifier having an input coupled to the input voltage, Vin, and configured with unity gain feedback to clamp the voltage at the drain of $M_3$ at Vin so that the voltages experienced by $M_3$ track the voltages experienced by Mpass, thereby maintaining performance of the $M_3$/Mpass mirror at low voltages. One advantage of the NMOS implementation described above in FIG. 3B is that the output of the regulator may be allowed to go to very low voltages without causing the sense transistor to move into the linear region of operation, for example.

It should further be noted that the embodiments described herein are applicable to any general power management integrated circuit ("PMIC") that needs a high speed transient load response current.

Figure 4:
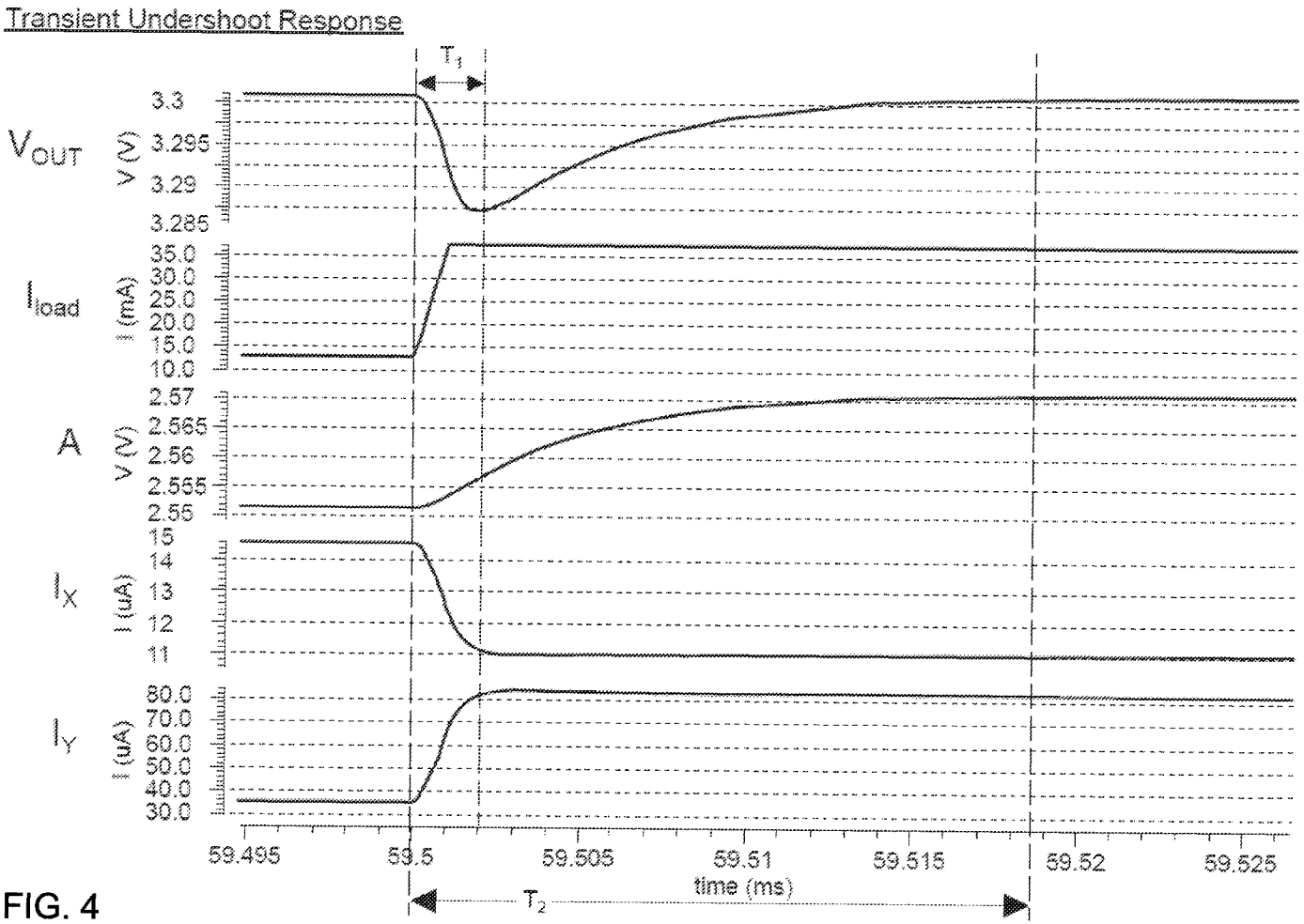
FIG. 4 depicts a graph of an example transient undershoot response for an embodiment of an LDO controller circuit designed according to the techniques described herein.

FIG. 4 depicts a graph of an example transient undershoot response for an embodiment of the LDO controller circuit depicted in FIG. 3A. In the illustrated embodiment, the transient load current $I_{Load}$ steps up from approximately 12 mA to approximately 38 mA in a time interval $T_1$, which is approximately equal to 1 μs. As shown in the graph, the loop current $I_X$ decreases quickly and the loop current $I_Y$ increases quickly within approximately 2 μs in response to match (compensate for) the changes in the output transient load current $I_{Load}$. This limits undershoot at the output $V_{OUT}$ of the LDO 40 to approximately 14 mV.

As the current in $I_X$ conducting in the first current mirror circuit transistor $M_{2A}$ changes, the gate-to-source voltage Vgs of the current sensing transistor $M_{SEN}$ changes. In this case, as $I_X$ decreases quickly, Vgs of $M_{SEN}$ decreases such that a DC offset can be observed at $V_{OUT}$. Referring to FIG. 3A, the error amplifier 301 detects this output voltage error via the feedback voltage signal Vfb and slowly drives the gate voltage of the current sensing transistor $M_{SEN}$ between the time interval $T_1$ and $T_2$. After the output node A of the error amplifier 301 stabilizes at $T_2$, the DC error at $V_{OUT}$ introduced by the current subtraction loop $I_{LOOP}$ is likewise diminished.

Figure 5:
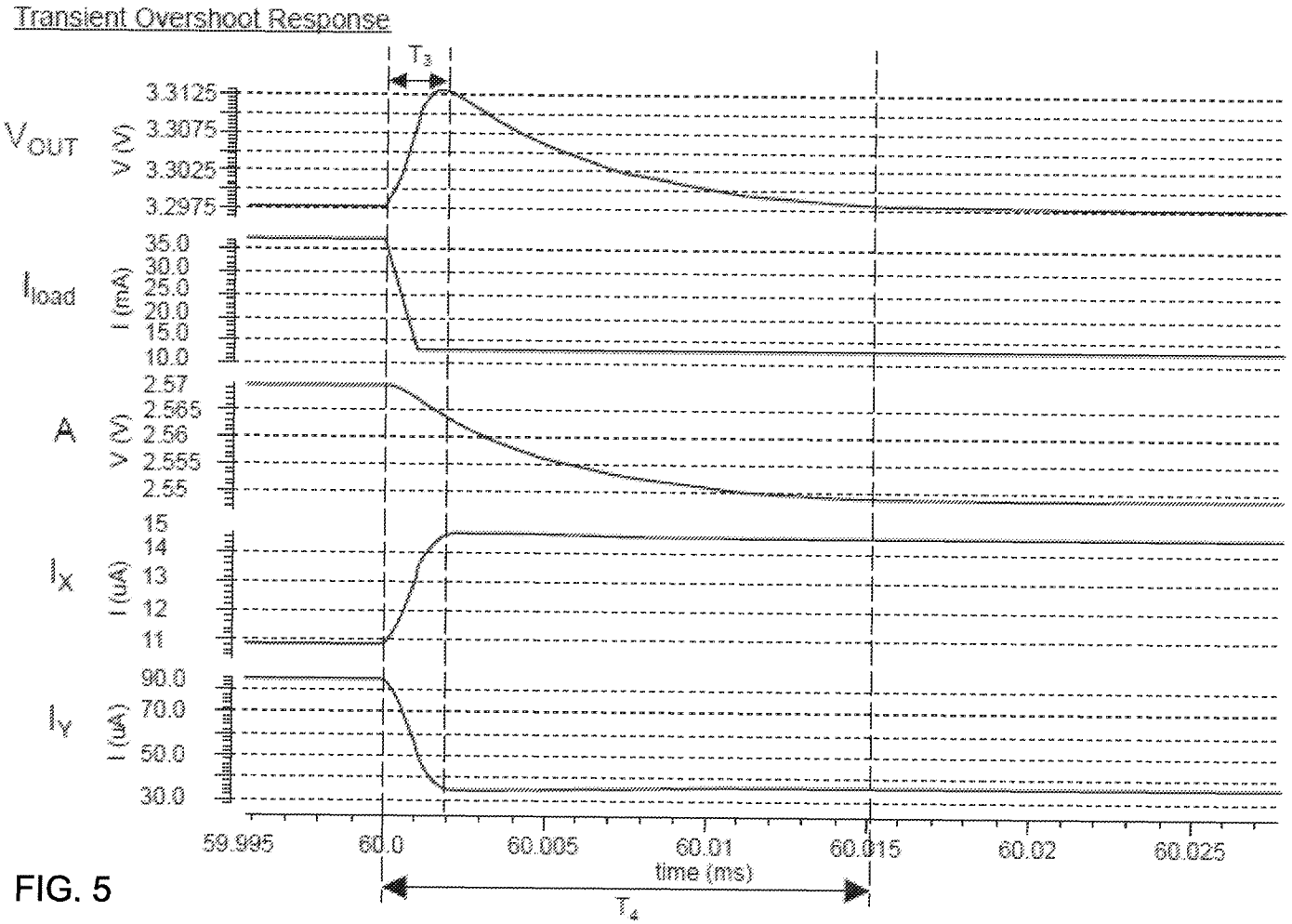
FIG. 5 depicts a graph of an example transient overshoot response for an embodiment of the LDO controller circuit designed according to the techniques described herein.

FIG. 5 depicts a graph of an example transient overshoot response for an embodiment of the LDO controller circuit depicted in FIG. 3A. In the illustrated embodiment, the transient load current $I_{Load}$ steps down from approximately 38 mA to approximately 12 mA in a time interval $T_3$, which is approximately equal to 1 μs. As shown in the graph, the loop current $I_X$ increases and the loop current $I_Y$ decreases quickly within approximately 2 μs in response to match (compensate for) the changes in the output transient load current $I_{Load}$. This limits overshoot at the output $V_{OUT}$ of the LDO 40 to approximately 14 mV.

As the current in $I_X$ conducting in the first current mirror circuit transistor $M_{2A}$ increases quickly, Vgs of $M_{SEN}$ increases such that a DC offset can be observed at $V_{OUT}$. Referring to FIG. 3A, the error amplifier 301 detects this output voltage error via the feedback voltage signal Vfb and slowly drives the gate voltage of the current sensing transistor $M_{SEN}$ between the time interval $T_3$ and $T_4$. After the output node A of the error amplifier 301 stabilizes at $T_4$, the DC error at $V_{OUT}$ introduced by the current subtraction loop $I_{LOOP}$ is also diminished.

Therefore the overshoot/undershoot performance of the circuit techniques described herein is determined by the current loop $I_{LOOP}$. In the over-current condition, $I_X$ drops to zero and all current in $I_{MAX}$ mirrors to $M_{PASS}$. The other interesting feature is that the current $I_{MAX}$ sets the limit for the output current because the difference current conducting in transistor $M_{3A}$ cannot ever exceed $I_{MAX}$.

II. Exemplary Processes

The processes described below are exemplary in nature and are provided for illustrative purposes and not intended to limit the scope of the embodiments described herein to any particular example embodiment. For instance, processes in accordance with some embodiments may include or omit some or all of the operations described below, or may include steps in a different order than described herein. The particular processes described are not intended to be limited to any particular set of operations exclusive of all other potentially intermediate operations.

In addition, the operations may be embodied in computer-executable code, which causes a general-purpose or special-purpose computer to perform certain functional operations. In other in stances, these operations may be performed by specific hardware components or hardwired circuitry, or by any combination of programmed computer components and custom hardware circuitry.

Figure 6A:
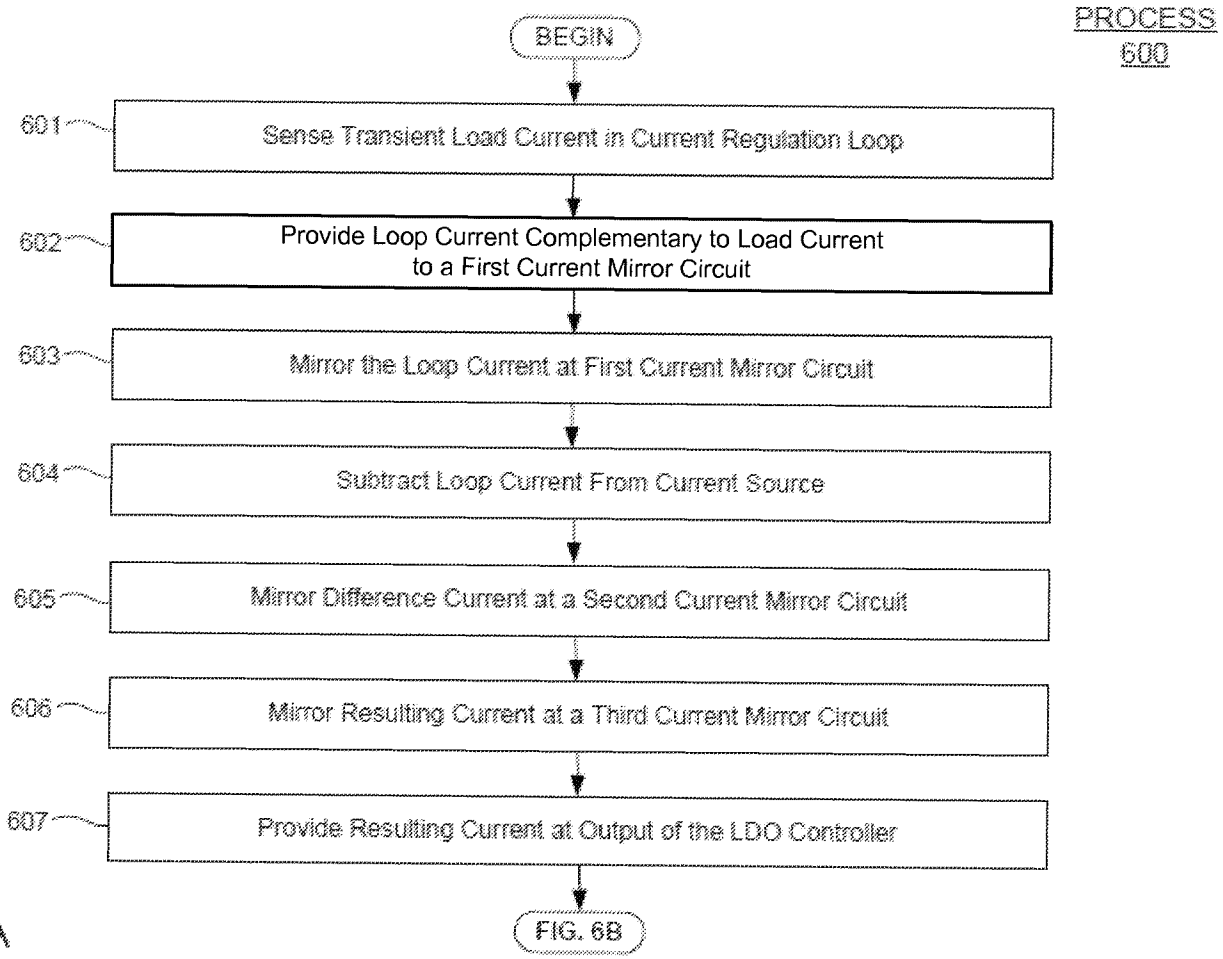
FIGS. 6A-6B depict a flow chart of an example embodiment of a process in a LDO controller circuit having a current regulation loop and a voltage regulation loop designed according to the techniques described herein with reference to the circuit configuration of FIG. 3A.
Figure 6B:
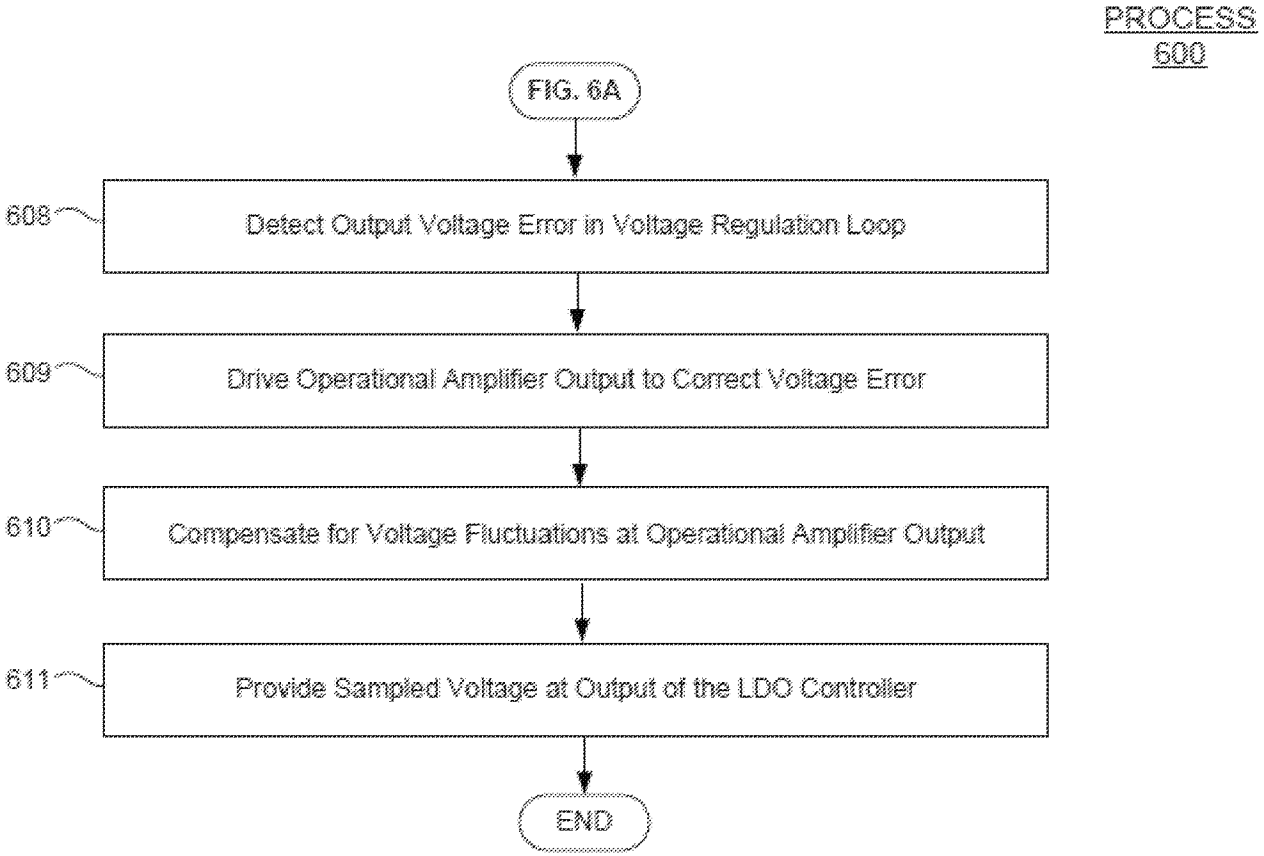

FIGS. 6A-6B depict a flow chart of an example embodiment of a process in a LDO controller circuit having a current regulation loop and a voltage regulation loop designed according to the techniques described herein with reference to the circuit configuration of FIG. 3A. In the illustrated embodiment of FIG. 6A, process 600 begins at operation 601 where the LDO controller circuit is configured to sense a transient load current in the current regulation loop at the output of the LDO. The transient load current can be sensed at a first terminal of a current sensing transistor coupled with the output of the LDO controller circuit. In one embodiment, the first terminal can be the source terminal of the current sensing transistor. Referring to FIG. 3A, the current sensing transistor $M_{SEN}$ is coupled between the output of the LDO controller circuit and a first current mirror circuit comprising a first transistor pair $M_{2A}/M_{2B}$ in the current regulation loop.

Process 600 continues at operation 602 by providing a first loop current $I_X$ that is complementary to the sensed transient load current from a second terminal of the current sensing transistor $M_{SEN}$ to the input of the first current mirror circuit $M_{2A}/M_{2B}$. The sense transistor $M_{SEN}$ can be configured to detect changes in load current at the output of the LDO and to conduct the first loop current $I_X$ complementary to the detected current changes. In one embodiment, the second terminal of the current sensing transistor $M_{SEN}$ can be the drain terminal, and the first loop current $I_X$ can be provided from the drain terminal of the current sensing transistor $M_{SEN}$ to the input of the first current mirror circuit $M_{2B}/M_{2A}$. The first loop current $I_X$ can then be mirrored from the input to the output of the first current mirror circuit (operation 603). Referring to FIG. 3A, the resulting current conducts in the output transistor $M_{2B}$. As discussed previously, the ratio of transistor device sizes in such current mirror circuits determines the relative magnitude of mirrored current that will be replicated from the input to the output.

Process 600 continues at operation 604 by subtracting the first loop current at the output of the first current mirror circuit from a constant current provided by a current source to obtain a difference current. Referring to FIG. 3A, the constant current is provided from the current source $I_A$ coupled between a voltage source $V_{dd}$ and an input of a second current mirror circuit comprising a second transistor pair $M_{3A}/M_{3B}$. The difference current is the current conducting in transistor $M_{3A}$. The difference current can then be mirrored to the output transistor $M_{3B}$ of the second current mirror circuit (operation 605).

As discussed above, the difference current conducting in the input transistor $M_{3A}$ is mirrored to the output transistor $M_{3B}$ based on the multiplication factor dictated by the relative device sizes of the input and output transistors of the second current mirror circuit. Accordingly, the difference current conducting in the input transistor $M_{3A}$ of the second current mirror circuit can be replicated to the current $I_Y$ conducting in the output transistor.

In at least certain embodiments, the resulting current $I_Y$ conducting in the output transistor $M_{3B}$ of the second current mirror circuit can be mirrored again by a third current mirror circuit comprising a third transistor pair $M_4/M_{PASS}$ (operation 606) and provided to the output of the LDO (operation 607).

Referring to FIG. 3A, the pass transistor $M_{PASS}$ is coupled between an input of the LDO controller circuit $V_{IN}$ and the output $V_{OUT}$ to provide a transient response current at the output of the LDO controller circuit. As discussed previously, the transient response current is the difference current conducting in the output transistor $M_{3A}$ of the second current mirror circuit multiplied by a factor. That factor includes the first multiplication factor of the second current mirror circuit $M_{3B}/M_{3A}$ multiplied by the second multiplication factor of the third current mirror circuit $M_{PASS}/M_4$.

The current gain achieved by the multiplication factors can then be supplied to the output $V_{OUT}$ of the LDO to correct the change in current flow due to the transient load current. As a result, during times of increased transient load current at the output of the LDO, the first loop current decreases and the resulting current conveyed to the output $V_{OUT}$ increases to compensate for the increased transient load current. And during times of decreased transient load current on the output of the LDO controller circuit, the first loop current increases and resulting current conveyed to the output $V_{OUT}$ decreases to compensate for the decreased transient load current.

Process 600 continues at FIG. 6B, which depicts a flow chart of an example embodiment of a process in a LDO controller circuit having a current regulation loop and a voltage regulation loop designed according to the techniques described herein with reference to the circuit configuration of FIG. 3A. In the illustrated embodiment, process 600 continues at operation 608 where the LDO controller circuit is configured to detect an error in the output voltage of the LDO controller circuit resulting from the transient load current. Referring to FIG. 3A, error amplifier 301 is configured to receive a feedback voltage $V_{fb}$ at a first input and a reference voltage $V_{ref}$ at a second input. The error amplifier 301 detects errors in the output voltage of the LDO controller circuit by comparing an output feedback voltage $V_{fb}$ at the first input terminal of the error amplifier with a reference voltage $V_{ref}$ at the second input terminal.

As discussed above, the feedback voltage $V_{fb}$ can be taken from a feedback node in a resistor divider network coupled with the output $V_{OUT}$ of the LDO. Such a resistor divider network is discussed below with reference to FIG. 8. Process 600 continues where the LDO controller circuit is configured to drive the output node of the error amplifier to a value to correct the output voltage error in response to detecting the error (operation 609). The error amplifier is configured to drive output node A as the voltages of $V_{fb}$ and $V_{ref}$ begin to differ at the input of the error amplifier 301. Referring to FIG. 3A, the output node A is coupled with the gate terminal of the current sensing transistor $M_{SEN}$ to drive node A to a value to correct the error in the output voltage $V_{OUT}$. The output node A of the error amplifier drives the gate terminal of the current sensing transistor as the voltage across the current sensing transistor $M_{SEN}$ changes with the load current.

Process 600 continues at operation 610 where the LDO controller circuit is configured to compensate for voltage fluctuations at the output node of the operational amplifier using only a single compensation capacitor. Referring to FIG. 3A, compensation capacitor Cc1 is coupled with the output node A of the error amplifier 301 to control overshoot and ringing in the error amplifier's step response and to improve the loop stability. The device size of the compensation capacitor can be reduced using a capacitor multiplier circuit as described below with reference to FIG. 7. The LDO controller circuit can also be configured to provide a sampled voltage at the output $V_{OUT}$ (operation 611) as discussed below with reference to FIG. 8. This completes process 600 according to one example embodiment.

III. Auxiliary Circuit Elements

Figure 7:
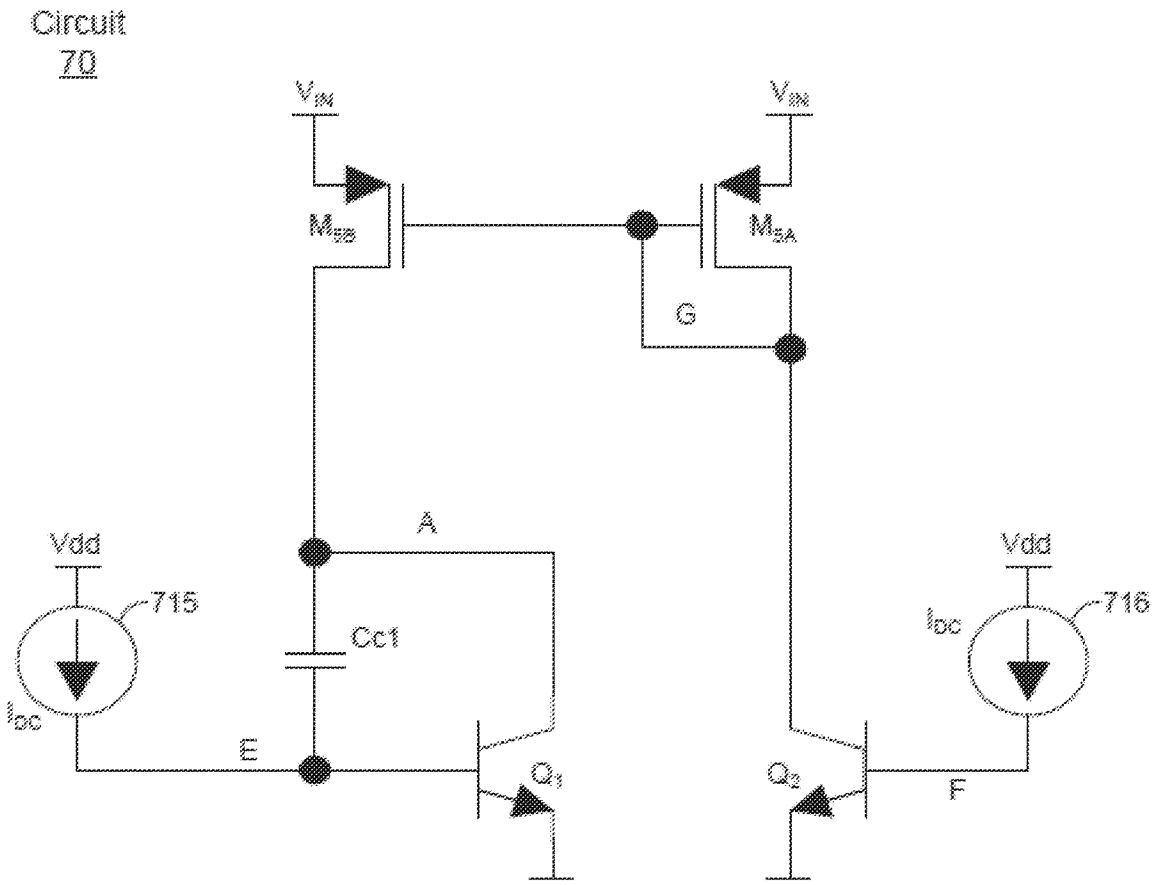
FIG. 7 depicts a circuit diagram of an example embodiment of a DC current compensated capacitor multiplier circuit designed according to the techniques described herein.

FIG. 7 depicts a circuit diagram of an example embodiment of a DC current compensated capacitor multiplier circuit designed according to the techniques described herein. The capacitor multiplier circuit 70 is configured to allow the compensation capacitor Cc1 to perform its stabilizing functions using a much smaller integrated circuit device area. In one embodiment, the capacitor multiplier circuit 70 can effectively reduce the device area required for the compensation capacitor Cc1 by 10 times.

In the illustrated embodiment, circuit 70 includes two DC current sources $I_{DC}$ coupled with the gate terminals of bipolar junction transistors Q1 and Q2 respectively. The compensation capacitor Cc1 is coupled between the gate and collector terminals of Q1. The collector terminal of Q1 corresponds to the output node A of the error amplifier 301 and the gate terminal of Q1 corresponds to node E in FIG. 3A.

Current conducts from $V_{IN}$ down through $M_{5B}$ and Q1 on the left hand side of the capacitor multiplier circuit 70. As a result the bipolar gain of the transistor Q1 increases the AC current across the compensation capacitor Cc1, thus increasing its effective capacitance based on the function of the capacitor multiplier circuit 70. The same capacitance can be achieved with a much smaller integrated circuit device area based on the increased charge flowing across the capacitor Cc1.

A replica transistor Q2 is utilized on the right hand side of the circuit 70 to compensate for the DC current. Current conducting in transistor $M_{5B}$ is mirrored to transistor $M_{5A}$. The resulting current conducts through transistor Q2 to provide the DC current compensation for circuit 70. It should be noted that the embodiment of circuit 70 can also be implemented with other types of transistors such as metal-oxide-semiconductor ("MOS") transistor technology.

Figure 8:
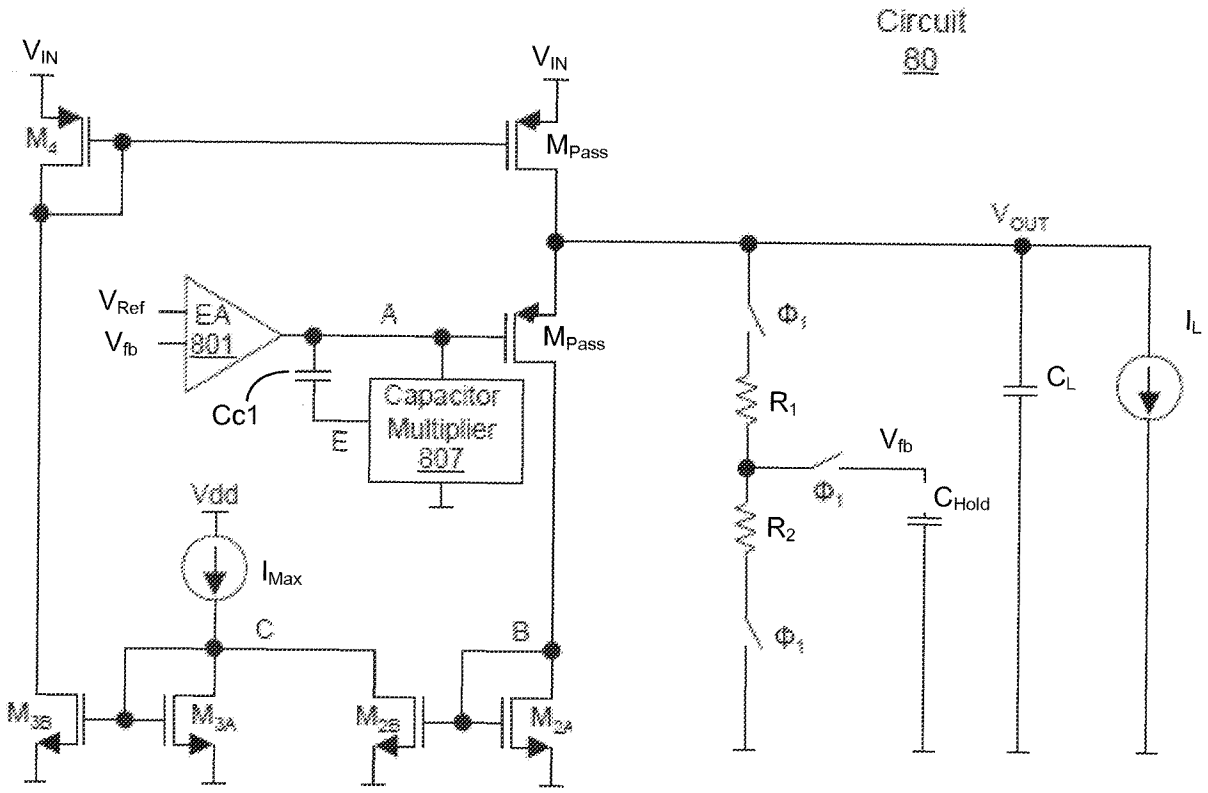
FIG. 8 depicts a circuit diagram of an example embodiment of a LDO controller circuit designed according to the techniques described herein that includes a sample and hold circuit at the output.

FIG. 8 depicts a circuit diagram of an example embodiment of a LDO controller circuit that includes a sample and hold circuit at the output. In the illustrated embodiment, the LDO controller circuit 80 includes the components described above with respect to FIG. 3A. In addition, circuit 80 further includes a sample and hold circuit and a resistor divider network both coupled with the output $V_{OUT}$ of the LDO.

The resistor divider network includes resistors R1 and R2. The feedback voltage $V_{fb}$ provided to the error amplifier is taken from the feedback voltage node Vfb in the resistor divider network.

The sample and hold circuit comprises capacitor $C_{HOLD}$ and three (3) switches operate operating at a frequency cycle equal to Φ and configured as shown in FIG. 8. In at least certain embodiments, the sample and hold circuit is configured to take advantage of the slow response of the voltage loop $V_{LOOP}$. By adjusting how often the output voltage $V_{OUT}$ is sampled and held in the capacitor $C_{HOLD}$, the average of the quiescent current can be adjusted, which provides reduced area of the entire circuit.

Figure 9:
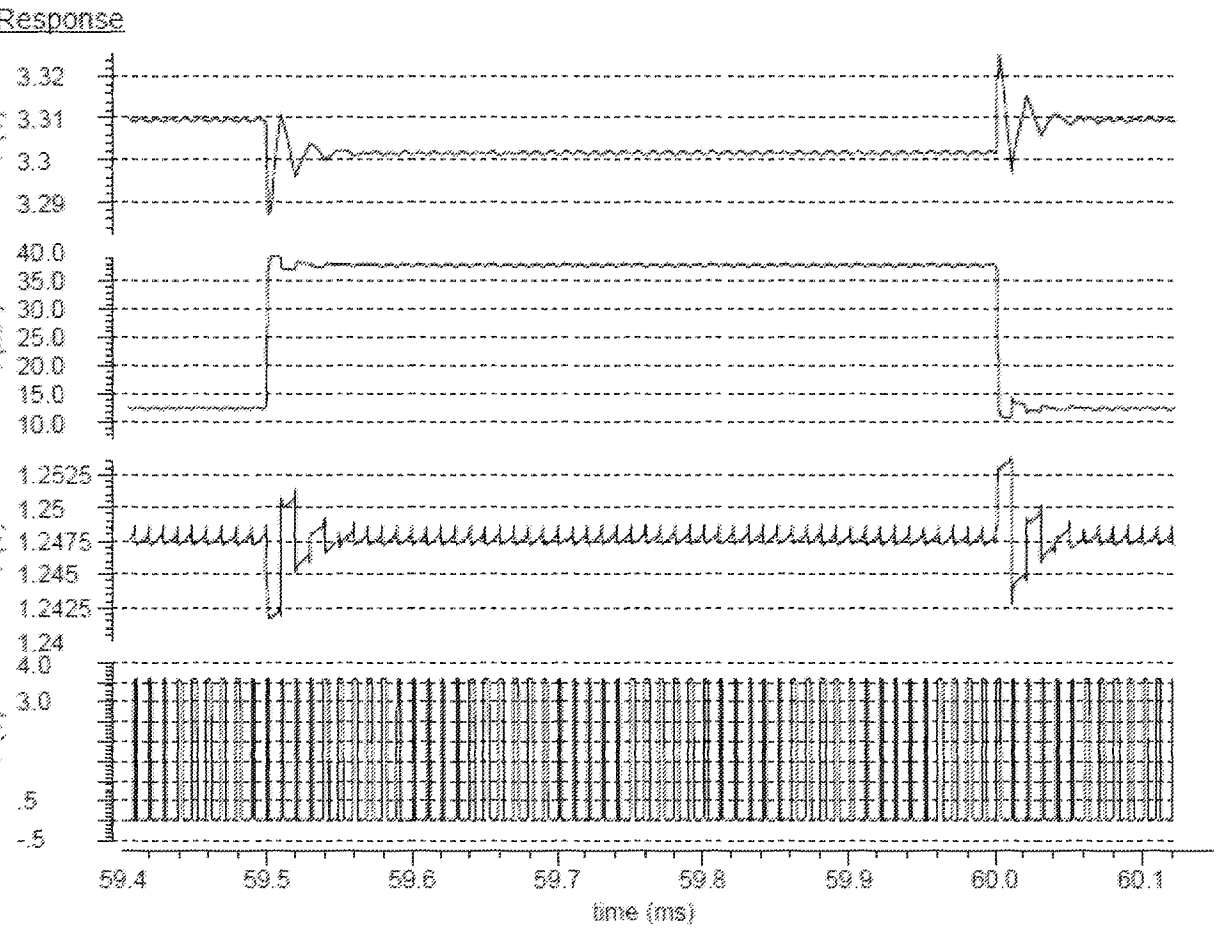
FIG. 9 depicts a graph of a transient response for the embodiment of the LDO controller circuit with a sample and hold circuit at the output.

FIG. 9 depicts a graph of the transient response for the embodiments of the LDO controller circuit that include the sample and hold circuit of FIG. 8 coupled with the output $V_{OUT}$. The transient response shown in FIG. 9 includes a 100 kHz sample and hold frequency Φ with a 25% duty cycle. As will be appreciated by persons of skill in the art, other different frequencies and duty cycles can be used in conjunction with the techniques described herein depending on the particular circuit design constraints and purpose. As shown in the illustrated embodiment, when the load current changes state, there's an initial ripple in the output voltage $V_{OUT}$ and in the feedback voltage node Vfb, which then stabilizes based on the function of the voltage loop $V_{LOOP}$ and the sample and hold circuit capacitor $C_{HOLD}$.

Figure 10:
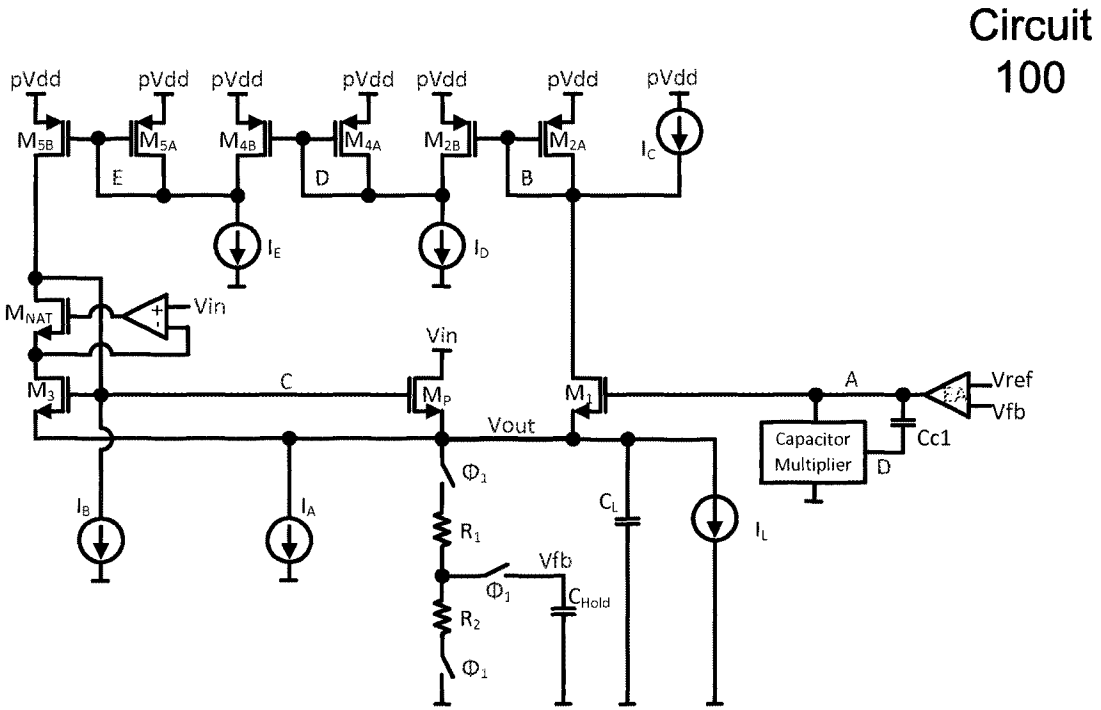
FIG. 10 depicts a circuit diagram of an alternate example embodiment of a regulator circuit with a dual-loop current and voltage regulation configuration designed according to the techniques described herein.

FIG. 10 depicts a circuit diagram of an alternate example embodiment of a regulator circuit with a dual-loop current and voltage regulation configuration designed according to the techniques described herein. In this example, the output voltage is coupled through a sample and hold circuit comprising switches ϕ1, ϕ2, and ϕ3, resistors R1 and R2, and capacitor Chold. The sample and hold circuit samples the output voltage Vout and stores the sampled value on capacitor Chold. The sampled voltage is used as the feedback voltage and provided as an input to the voltage regulation loop circuitry to control the gate of Msns.

The advantages of certain circuit configurations and techniques described herein are numerous. First, embodiments including the dual-loop single dominant pole configuration may greatly simplifies the compensation network and reduces integrated circuit device area requirements because the buffer circuit 102 and compensator circuit 103 are no longer needed. In some embodiments, the maximum current may be limited by the constant current source IA, so a separate OCP loop and a soft start circuit of conventional designs are no longer needed. Also, in some traditional single loop LDO controller circuits, the control circuits occupied a large area on the die, and very high switching frequency was required if a duty cycle-based feedback network is used, which increases dynamic switching losses. Particular embodiments described herein may not require such a large amount of integrated circuit device area or high switching frequency. Moreover, only a single compensation capacitor is used in some embodiments described above, and its area can be reduced using the capacitor multiplier circuit as described herein.

Further, in some embodiments, a fast current loop can enable performance for transient currents, and the slow voltage loop can be implemented in a switching scheme to further reduce the integrated circuit area requirements for the feedback network without needing a very fast clock frequency. The feedback network can have a lower frequency duty cycle for additional integrated circuit device area savings. Thus, switching loss may also be reduced using the circuit techniques described herein. The loop bandwidths of the slow voltage feedback loop $V_{LOOP}$ can be two to three times smaller than the clock frequency of the remainder of the circuit, for example.

Throughout the foregoing description, for the purposes of explanation, numerous specific details were set forth in order to provide a thorough understanding of the invention. It will be apparent, however, to persons skilled in the art that these embodiments may be practiced without some of these specific details. The above examples and embodiments should not be deemed to be the only embodiments, and are presented to illustrate the flexibility and advantages of the present invention. Other arrangements, embodiments, implementations and equivalents will be evident to those skilled in the art and may be employed without departing from the spirit and scope of the invention as defined by the following claims.

What is claimed is:

1. A regulator circuit comprising a current regulation loop and a voltage regulation loop, the current regulation loop comprising:

a pass transistor having a first terminal coupled with an input of the regulator circuit and a second terminal coupled with an output of the regulator circuit;

a current sensing transistor configured to sense a load current at a first terminal coupled with the output of the regulator circuit and to output a first loop current complementary to the load current from a second terminal of the current sensing transistor;

a first current mirror circuit comprising a first transistor pair configured to receive the first loop current and to mirror the first loop current from input to output of the first current mirror circuit;

a current summation circuit configured to subtract the first loop current at the output of the first current mirror circuit from a constant current provided by a current source to obtain a difference current; and at least a second current mirror circuit comprising a second transistor pair coupled with the current summation circuit and configured to convey the difference current multiplied by a factor to the pass transistor to provide a response current at the output of the regulator circuit.

2. The regulator circuit of claim 1 wherein the voltage regulation loop comprises an input coupled to an output voltage of the regulator circuit and an output coupled to a control terminal of the sense transistor.

3. The regulator circuit of claim 2 wherein the voltage regulation loop further comprises a compensation capacitor coupled to a control terminal of the sense transistor.

4. The regulator circuit of claim 3 wherein the voltage regulation loop further comprises a capacitor multiplier circuit coupled with the compensation capacitor.

5. The regulator circuit of claim 1 wherein the voltage regulation loop comprises an operational amplifier configured to:

detect an error in an output voltage of the regulator circuit by comparing an output feedback voltage at a first input terminal of the operational amplifier with a reference voltage at a second input terminal of the operational amplifier; and drive an output node of the operational amplifier to a value to correct the error in the output voltage, wherein the output node of the operational amplifier is coupled with a control terminal of the current sensing transistor.

6. The regulator circuit of claim 5 wherein the output node of the operational amplifier is configured to drive the control terminal of the current sensing transistor as voltage across the current sensing transistor changes with the load current.

7. The regulator circuit of claim 1 wherein the current regulation loop further comprises a third current mirror circuit comprising a third transistor pair including the pass transistor, the third current mirror circuit configured to:

receive the difference current multiplied by a first multiplication factor from the second current mirror circuit to obtain a second loop current; and mirror the second loop current from input to output of the third current mirror circuit to convey the difference current multiplied by a second multiplication factor to the pass transistor at the output of the regulator circuit.

8. The regulator circuit of claim 7 wherein the first multiplication factor is determined based on relative device sizes of the second transistor pair of the second current mirror circuit, and the second multiplication factor is determined based on relative device sizes of the third transistor pair of the third current mirror circuit.

9. The regulator circuit of claim 1 wherein during times of increased load current at the output of the regulator circuit, the first loop current decreases and current conveyed to the output of the regulator circuit increases to compensate for the increased load current.

10. The regulator circuit of claim 1 wherein during times of decreased load current on the output of the regulator circuit, the first loop current increases and current conveyed to the output of the regulator circuit decreases to compensate for the decreased load current.

11. The regulator circuit of claim 1 wherein during times of increased load current at the output of the regulator circuit, the first loop current increases and current conveyed to the output of the regulator circuit increases to compensate for the increased load current.

12. The regulator circuit of claim 1 wherein during times of decreased load current on the output of the regulator circuit, the first loop current decreases and current conveyed to the output of the regulator circuit decreases to compensate for the decreased load current.

13. The regulator circuit of claim 1 wherein maximum current conveyed to the output of the regulator circuit is limited by the constant current provided by the current source.

14. The regulator circuit of claim 1 further comprising a sample and hold circuit configured to provide a sampled output voltage at the output of the regulator circuit.

15. The regulator circuit of claim 1 wherein the regulator circuit is a low drop out (LDO) regulator.

16. A regulator circuit comprising:

a pass transistor having a first terminal to receive an input voltage, a second terminal to provide a regulated output voltage to an output of the regulator circuit, and a control terminal;

a current sense transistor having a first terminal coupled with the second terminal of the pass transistor at the output of the regulator circuit, a second terminal, and a control terminal;

a current regulation loop coupled between the second terminal of the current sense transistor and the control terminal of the pass transistor, the current regulation loop comprising a plurality of current mirrors and one or more current summation circuits; and a voltage regulation loop coupled between the output of the regulator circuit and the control terminal of the current sense transistor.

17. The regulator circuit of claim 16 wherein the pass transistor is a PMOS transistor and the current sense transistor is a PMOS transistor, and wherein a source of the current sense transistor is coupled to a drain of the pass transistor.

18. The regulator circuit of claim 16 wherein the pass transistor is a NMOS transistor and the current sense transistor is a NMOS transistor, and wherein a source of the current sense transistor is coupled to a source of the pass transistor.

19. The regulator circuit of claim 16 wherein when a current through the current sense transistor increases, the current regulation loop decreases a current through the pass transistor, and wherein when the current through the current sense transistor decreases, the current regulation loop increases the current through the pass transistor.

20. The regulator circuit of claim 16 wherein when a current through the current sense transistor increases, the current regulation loop increases a current through the pass transistor, and wherein when the current through the current sense transistor decreases, the current regulation loop decreases the current through the pass transistor.

21. A method of generating a regulated voltage comprising:

receiving an input voltage on a first terminal of a pass transistor, and in accordance therewith, providing a regulated output voltage from a second terminal of the pass transistor to an output of the regulator circuit;

sensing a current in a current sense transistor that is complementary to a load current, the current sense transistor having a first terminal coupled with the second terminal of the pass transistor at the output of the regulator circuit;

coupling the current in the current sense transistor through a plurality of current mirrors and one or more current summation circuits to form a current regulation loop, wherein one of the current mirrors includes the pass transistor; and coupling the output voltage from the output of the regulator circuit to a control terminal of the current sense transistor to form a voltage regulation loop.

22. The method of claim 21 further comprising:

detecting an error in the output voltage of the regulator circuit resulting from the load current by comparing an output feedback voltage at a first input terminal of an operational amplifier with a reference voltage at a second input terminal of the operational amplifier; and driving an output node of the operational amplifier to a value to correct the output voltage, wherein the output node of the operational amplifier is coupled with the control terminal of the current sensing transistor.

23. The method of claim 22 wherein the output node of the operational amplifier is configured to change a voltage on a capacitor coupled to the control terminal of the current sensing transistor as voltage across the current sensing transistor changes with the load current.

24. The method of claim 21 wherein when the current through the current sense transistor increases, the current regulation loop decreases a current through the pass transistor, and wherein when the current through the current sense transistor decreases, the current regulation loop increases the current through the pass transistor.

25. The method of claim 21 wherein when the current through the current sense transistor increases, the current regulation loop increases a current through the pass transistor, and wherein when the current through the current sense transistor decreases, the current regulation loop decreases the current through the pass transistor.

26. The method of claim 21 wherein maximum current in the pass transistor is limited by a constant current provided by a current source in at least one current summation circuit.

27. The method of claim 21 further comprising providing a sampled output voltage at the output of the regulator circuit using a sample and hold circuit.

28. A regulator circuit comprising:

pass transistor means for receiving an input voltage and providing an output voltage to an output of the regulator circuit;

means for generating a complementary current to a load current at the output of the regulator circuit;

means for mirroring the complementary current and performing one or more current summations to form a current regulation loop with the pass transistor means; and means for coupling the output voltage from the output of the regulator circuit to the means for generating a complementary current to form a voltage regulation loop.

29. The regulator circuit of claim 28 further comprising:

a capacitor means for compensating for voltage fluctuations at output of the regulator circuit; and a capacitor multiplier means for reducing the device size of the capacitor means.

30. The regulator circuit of claim 28 further comprising means for providing a sampled output voltage at output of the regulator circuit.

* * * * *